US009140521B2

(12) United States Patent
Millett

(10) Patent No.: US 9,140,521 B2
(45) **Date of Patent: *Sep. 22, 2015**

(54) D-SCOPE AIMING DEVICE

(71) Applicant: James A. Millett, Huntington Beach, CA (US)

(72) Inventor: James A. Millett, Huntington Beach, CA (US)

( * ) Notice: Subject to any disclaimer, the term of this patent is extended or adjusted under 35 U.S.C. 154(b) by 79 days.

This patent is subject to a terminal disclaimer.

(21) Appl. No.: 14/058,617

(22) Filed: Oct. 21, 2013

(65) Prior Publication Data

US 2014/0042224 A1 Feb. 13, 2014

Related U.S. Application Data

(63) Continuation of application No. 13/412,506, filed on Mar. 5, 2012, now Pat. No. 8,807,430.

(51) Int. Cl.

| | |
|---|---|
| ***G06G 7/80*** | (2006.01) |
| ***F41G 1/44*** | (2006.01) |
| ***F41G 1/38*** | (2006.01) |
| ***F41G 1/473*** | (2006.01) |
| ***F41G 1/00*** | (2006.01) |

(52) U.S. Cl.

CPC .. *F41G 1/44* (2013.01); *F41G 1/00* (2013.01); *F41G 1/38* (2013.01); *F41G 1/473* (2013.01)

(58) Field of Classification Search

USPC ..... 235/404, 400, 407

See application file for complete search history.

(56) References Cited

U.S. PATENT DOCUMENTS

| | | | | |
|---|---|---|---|---|
| 5,824,942 | A | 10/1998 | Mladjan et al. | |
| 7,121,036 | B1 | 10/2006 | Florence et al. | |
| 7,124,531 | B1 | 10/2006 | Florence et al. | |
| 7,210,262 | B2 | 5/2007 | Florence et al. | |
| 7,292,262 | B2 | 11/2007 | Towery et al. | |
| 8,807,430 | B2 * | 8/2014 | Millett | 235/407 |
| 2004/0088898 | A1 | 5/2004 | Barrett | |
| 2007/0277421 | A1 | 12/2007 | Perkins et al. | |
| 2011/0207089 | A1 | 8/2011 | Lagettie et al. | |
| 2012/0000979 | A1 | 1/2012 | Horvath et al. | |
| 2012/0118955 | A1 * | 5/2012 | Cox et al. | 235/404 |
| 2012/0126002 | A1 * | 5/2012 | Rudich | 235/404 |

FOREIGN PATENT DOCUMENTS

| | | |
|---|---|---|
| WO | WO2011-102894 | 8/2011 |

OTHER PUBLICATIONS

International Search Report and Written Opinion, dated Nov. 19, 2013, from related International Application No. PCT/US2013/024986.

* cited by examiner

*Primary Examiner* — Daniel Hess

(74) *Attorney, Agent, or Firm* — Greenberg Traurig, LLP

(57) ABSTRACT

An improved electronic aiming device for use with a weapon or other manually aimed device. Means are provided to vary the field of view, determine range to target, compensate for bullet drop, and to compensate for crosswind, without removing either hand from the weapon, by monitoring the tilt of the weapon upon which the device is mounted.

17 Claims, 2 Drawing Sheets

D-SCOPE AIMING DEVICE

CROSS REFERENCE TO RELATED APPLICATIONS

This application is a continuation of U.S. patent application Ser. No. 13/412,506, filed Mar. 5, 2012, entitled D-scope Aiming Device, now U.S. Pat. No. 8,807,430, issued Aug. 19, 2014, which is incorporated by reference herein in its entirety.

BACKGROUND OF THE INVENTION

1. Field of the Invention

This invention is directed to aiming devices, in general, and to aiming devices with electronically enhanced target acquisition capabilities, in particular.

2. Prior Art

When making a long range shot with a firearm, the shooter must first determine a firing solution based on distance to target (Range), bullet drop due to the flight characteristic of the bullet and gravity (Drop), and crosswind component of the wind that is blowing at the time of firing (Windage).

Typically, the shooter will have a chart taped to the side of his weapon, or will have memorized the values for each of the corrections i.e. Drop and Windage at various Ranges and wind velocities. The shooter must then make a correction for each of these component values. Two methods are commonly used for this purpose. The first is to manually adjust the turrets on an optical aiming device so that the reticule is directing the shooter to the corrected target position. The second alternative is to use what is commonly called "Holdover" by those skilled in the art. There are many types of optical aiming devices that have graduated reticules for this purpose. The shooter places the target at a different position on the reticule based on its graduations.

There are numerous "Optical solutions" to the "Automatic Firing solution" problem sited in previous patents; however, few seldom survive in the marketplace because of the high cost of automatically moving optical components and the difficulty of maintaining accuracy with repeated impact from a weapon.

SUMMARY OF THE INSTANT INVENTION

The instant invention is composed of: an image sensor and a lens for acquiring video images of objects at which the aiming device is aimed; an image processor; a tilt sensor for sensing the force of gravity in relation to the aiming device; a display component for displaying the video images captured by the image sensor, and processed by the image processor; a eyepiece lens to allow the user to view the display component; a pressure and temperature sensor to sense atmospheric conditions, and suitable means to house said components.

The instant invention provides a completely "Solid state digital" and "Hands Free" solution to the task of accurately firing a weapon at long Range. The shooter is able to input all of the necessary information to make a long range shot at the time of firing without removing his hands from the weapon, by simply tilting the weapon from side to side.

A predetermined threshold angle defines the tilt function. For purposes of explanation, let us say this is 10 degrees. If the tilt angle of the weapon is less than 10 degrees in either direction i.e. left or right, a calculation is made for Windage adjustment. A representation of the amount of Windage adjusted for, is superimposed; along with a suitable crosshair symbol to define aim point, on a video image presented to the shooter. If the tilt angle is greater than 10 degrees in either direction, a range number superimposed on the video image, is progressively increased or decreased dependent on the direction and magnitude of the tilt angle greater than 10 degrees. The field of view i.e. (the magnification power) of the video image presented to the shooter is simultaneously increased or decreased in relation to the Range number, if the field of view is within field of view limits defined by the front lens and the image sensor.

A Range finding circle is also superimposed on the video image. This circle represents a predetermined target size. The circle remains a fixed size on the display component, if the field of view is greater than its minimum. If the field of view is at minimum, the Range finding circle size is progressively adjusted to a smaller size in relation to the Range setting. To find the distance to target, the shooter adjusts the Range setting by tilting the weapon more than 10 degrees left or right until the target fits the Range finding circle.

As described above, the instant invention provides a durable aiming device with no visible external controls. All ballistic calculations necessary for long-range shooting are performed automatically in relation to internal sensors and settings performed by tilting the weapon; thereby, rendering a simple and easy to use aiming device.

DESCRIPTION OF A PREFERRED EMBODIMENT

Figure 1:
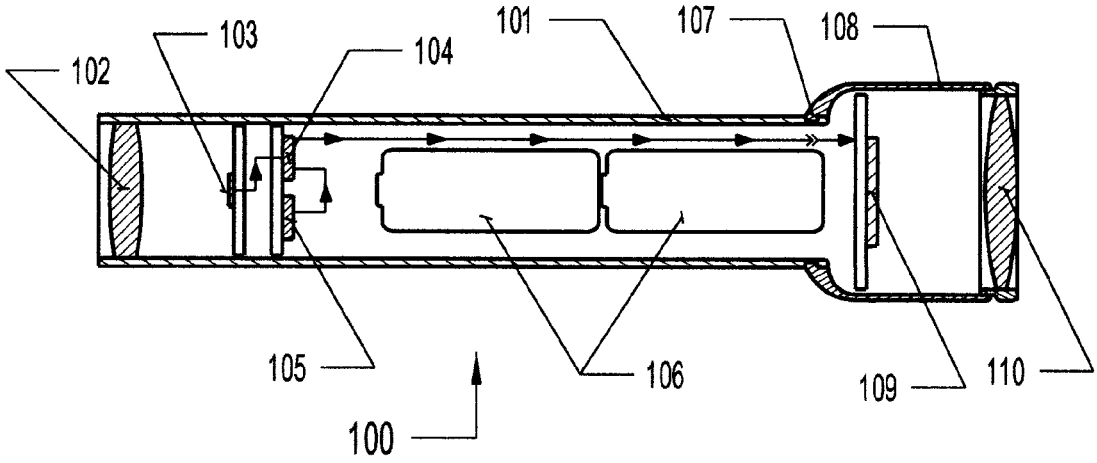
FIG. 1 is a schematic cutaway representation of one embodiment of the instant invention.

Referring now to FIG. 1, there is shown a representative cutaway schematic view of one embodiment of the aiming system 100 of the instant invention. Of course other configurations can be utilized depending on the actual use of the aiming device, e.g. with a rifle, with a hand gun, or other types of devices that need to be manually aimed.

The system (or device) shown in FIG. 1 includes an elongated tubular housing 101, typically, but not limitatively fabricated from anodized aluminum or the like. The housing 101 provides: the means to mount the front lens 102 and an enclosure for, the image sensor 103, the image processor 104 and its associated components, and the batteries 106 that provide power to the system. The housing 101 may also include an integral mounting system (not shown) for the purpose of mounting the aiming device 100 to the weapon upon which it will be used. The front lens 102 is mounted so as to focus light from the object at which the device is aimed onto the image plane of the image sensor 103.

An easily removable viewer section 108 is mounted to the rear end of the elongated tubular housing 101 by a mounting system 107 that provides mechanical and electrical connection to the elongated tubular housing 101. The mounting system 107 may be of bayonet type, threaded, or any other suitable mounting system that can maintain mechanical and electrical connection during the firing of the weapon.

The viewer section 108 is a housing with an adjustable diopter eyepiece lens 110 threadably mounted to its rear end, to allow the shooter to observe the internally housed image display component 109 at a close distance.

The viewer section 108 is removeably mounted so as to facilitate battery replacement and computer connection for setup and initial sighting in procedures. The image processor 104 and its associated components may be connected to a computer with appropriate software (not described) by removing the image viewer section and batteries 106 so as to allow use of a computer connection device (not described). Appropriate software will allow the shooter to input static information such as; windage and elevation settings to align the aiming device 100 to the weapon, ballistic correction information, choices of options, etc., to the image processor 104.

The image processor 104 is responsible for: controlling the image sensor 103; receiving the raw video image data from the image sensor 103; receiving tilt data from the tilt sensor 105; receiving atmospheric data from the pressure and temperature sensor (not shown for purposes of clarity); making ballistic calculations to determine image offset; formatting all of the above with an information overlay; and to send the formatted video image information to the image display component 109.

Figure 2:
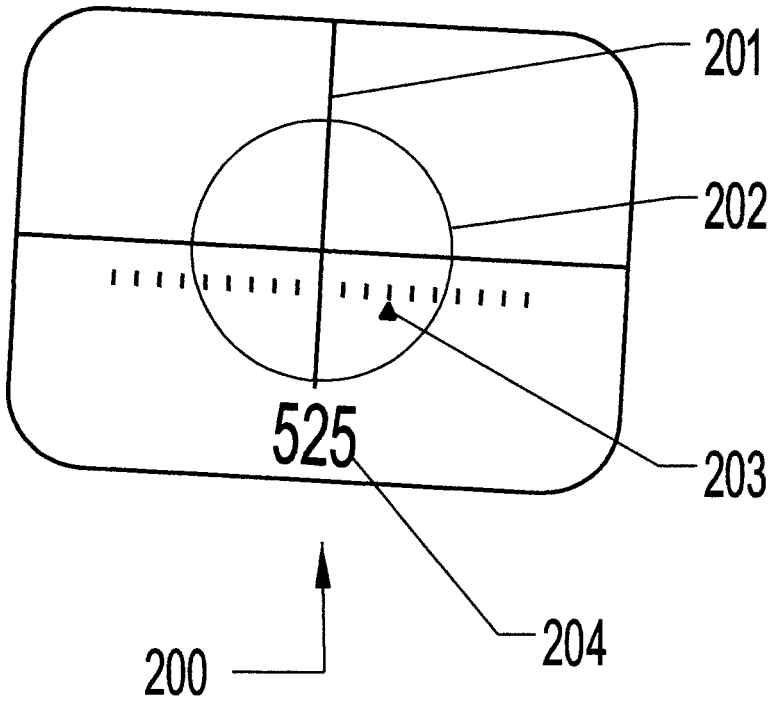
FIG. 2 is a representation of one of many possible video image overlays.

Referring now to FIG. 2, there is shown a representation 200 of one of many possible video image overlays that may be used. The crosshairs 201 are used to define an aiming position within the video image (not shown). The range number 204 simply displays the range setting that is controlled by tilting the weapon upon which the aiming device is mounted. The units of measure can be yards or meters selectable by the user, via computer link. The crosswind correction symbol 203 in conjunction with tick marks identifies the amount of crosswind corrected for in miles per hour or kilometers per hour. With optional English units chosen, the overlay 200, as shown, is representing that a crosswind of 3 miles per hour coming from the right is being corrected for, and a bullet drop calculated for a distance to target of 525 yards is being corrected for.

Bullet drop is corrected for by shifting the video image (not shown) up a calculated amount in relation to the crosshairs 201, based on the calculated bullet drop and the field of view. This causes the shooter to elevate the shooting axis of the weapon in order to put the crosshairs 201 on the target.

If there is no crosswind present; obviously, there is no crosswind correction needed. In this scenario, the shooter needs to know if the weapon is level. The crosswind correction symbol 203, by default performs that function. A skilled shooter knows that if the weapon is fired in a tilted condition, the bullet will miss the target in the direction of tilt by the amount of; the sine of the tilt angle times the bullet drop. This is because the force of gravity that causes the bullet to drop is no longer acting in the same plane as the weapon.

Crosswind is corrected for by two methods. The first method is created naturally by the fact that the shooter must tilt the weapon toward the source of the crosswind at the time of firing in order to inform the image processor 104 that a crosswind correction is needed. The second method is to shift the video image (not shown) sideways a calculated amount relative to the crosshairs 201, in the direction that the crosswind is coming from in the amount of, crosswind correction needed, minus (the sine of the tilt angle times bullet drop).

It should be noted, that the force of a crosswind of 25 miles per hour will approximately equal the force of gravity on the bullet being fired. If crosswind correction by tilt angle only were to be used, it would require the weapon to be tilted 45 degrees in a 25 mile per hour crosswind. Two-method crosswind correction; as previously described, is employed to provide convenient tilt angles to inform the image processor 104 of the crosswind correction needed.

Distance to target (Range) is determined by the "Stadiametric method". This method of finding distance was known to ancient cultures and is used in some optical sighting devices; but, is believed to have never been used in a digital sighting device. The image sensor 104 by itself cannot provide information to measure Range. It can only provide information to measure angular displacement of an object within its field of view. If the physical size of an object is known, the distance to the object can then be calculated by simple trigonometry using angular displacement derived from the video image (not shown) and a suitable overlaid size reference; such as range circle (202).

The shooter is able to instruct the image processor 104 to change the field of view of the video image (not shown) by tilting the weapon; left or right, to an angle greater than the predetermined tilt angle threshold. The field of view of the video image (not shown) has physical limits determined by the image sensor 103 and the front lens 102. For purposes of explanation, let us say that the image sensor 103 has a resolution of 2560×1920 pixels and the image display component 109 has a resolution of 320×240 pixels. The minimum field of view of the video image (not shown) i.e. (maximum magnification) occurs when the image sensor 103 is instructed to send only a small portion of its total field that is 320×240 pixels. In this scenario, the data from one pixel on the image sensor 103 controls the output of one pixel on the image display component 109. The maximum field of view of the video image (not shown) i.e. (minimum magnification) occurs when the image sensor 103 is instructed to send its entire field of 2560×1920 pixels. In this scenario selected blocks of pixels are combined by the image sensor 103 and the image processor 104, with a process called "binning" and are then sent to control one pixel on the image display component 109. In order to perform the range finding function with a high degree of resolution, the field of view of the video image (not shown) must be progressively altered between maximum and minimum in small steps. The algorithm for the process of variable binning so as to cause a fixed resolution of 320×240 pixels for the image display component 109 is quite complicated and is deemed, unnecessary to describe other than to say. The field of view of the image sensor 103 will vary from 2560×1920 pixels to 320×240 pixels in small steps, and the resolution of the image displayed by the image display component 109 will remain fixed at 320×240 pixels. This causes a variable magnification ratio of 8 to 1.

At very long distances to the target and depending on the target size and range optionally selected by the shooter, at maximum magnification the target may not be large enough to fit the range circle 202. In this scenario, the Range number 204 will continue to respond to tilt angles greater than the tilt-angle threshold, but the size of the Range circle 202 will be reduced in relation to the Range number 204.

Turning the aiming device ON is accomplished by removing a front lens cover (not described) from the aiming device. Putting the aiming device in a low power standby state is accomplished by replacing a front lens cover on the aiming device. Naturally, removing the batteries will disable the device for storage, but will not erase static information stored in nonvolatile memory.

Thus, there is shown and described a unique design and concept of a digital aiming device. While this description is directed to particular embodiments, it is understood that those skilled in the art may conceive modifications and/or variations to the specific embodiments shown and described herein. Any such modifications or variations which are within the purview of this description are intended to be included therein as well. It is understood that the description herein is intended to be illustrative only and is not intended to be limitative. Rather, the scope of the invention described herein is limited only by the claims appended hereto.

The invention claimed is:

1. An aiming device comprising:

an image sensor in an aiming device for acquiring video images of objects at which the aiming device is aimed;

an image processor in the device for processing an acquired video image; and an image display component in the device for displaying video images acquired by the image sensor and processed by the image processor wherein the image processor is configured to:

generate a video image and display the video image on the display component, superimpose at least one aim point reference marking on the video image displayed by the image display component, and adjust a field of view of the video image on the display component to compensate for at least one of bullet drop and crosswind, and;

wherein a rotation; less than a predetermined threshold about an axis of shooting of a weapon upon which the aiming device is mounted causes the image processor to calculate a crosswind compensation, and to display the amount of crosswind being compensated for superimposed on the video image displayed by the image display component.

2. The aiming device set forth in claim 1, wherein the processor is configured to adjust the field of view vertically to compensate for bullet drop and laterally for crosswind.

3. The aiming device set forth in claim 1, wherein a clockwise or counter clockwise rotation greater than a predetermined threshold about an axis of shooting of the weapon upon which the aiming device is mounted causes the image processor to decrease or increase respectively the field of view of the video image displayed by the image display component.

4. The aiming device set forth in claim 1 further comprising a tilt sensor in the device for sensing tilt due to gravity of the aiming device of the weapon upon which the aiming device is mounted.

5. The aiming device set forth in claim 1, further comprising a gravitational tilt sensor and wherein a range change is indicated by the field of view change of the video image on the display component.

6. The aiming device set forth in claim 5 wherein the microprocessor is configured to vertically shift the field of view of the video image displayed on the video display component to account for bullet drop.

7. An aiming device comprising:

an image sensor in an aiming device coupled to a lens for acquiring video images of objects at which the aiming device is aimed;

an image processor connected to the image sensor for processing the acquired images;

at least one of a pressure sensor and a temperature sensor to sense atmospheric conditions; and an image display component for displaying the video images captured by the image sensor and processed by the image processor, wherein the image processor is configured to calculate bullet drop based on a distance to target derived from input received from a user, ballistic data and the sensed atmospheric conditions, wherein a rotation; less than a predetermined threshold about an axis of shooting of a weapon upon which the aiming device is mounted causes the image processor to calculate a crosswind compensation, and to display the amount of crosswind being compensated for superimposed on the video image displayed by the image display component.

8. The aiming device set forth in claim 7, wherein the image processor is configured to superimpose a target size reference symbol on the video image displayed by the image display component, for the purpose of determining the distance to a target object of known size, by altering a field of view of the video image displayed by the image display component to make the image of the target object of known size fit the target size reference symbol.

9. The aiming device set forth in claim 8, wherein the field of view displayed by the image display component is altered by tilting the weapon upon which the aiming device is mounted.

10. An aiming device comprising:

an image sensor in an aiming device for acquiring video images of objects at which the aiming device is aimed;

a tilt sensor in the device;

an image processor in the device for processing an acquired video image; and an image display component in the device for displaying a field of view of the acquired video image, wherein the image processor is configured to:

calculate bullet drop based on ballistic data;

receive a range input from a user aiming the device by the user tilting the aiming device beyond a predetermined threshold; and alter the field of view of the video image displayed by the video image display component based on the received range input and calculated bullet drop, wherein the processor causes the video image on the display component to shift vertically upon each tilt of the aiming device beyond the predetermined threshold.

11. The device according to claim 10 wherein the field of view is vertically shifted based on calculated bullet drop.

12. The aiming device set forth in claim 10, wherein a clockwise or counter clockwise rotational tilt; greater than a predetermined threshold about an axis of shooting of the weapon upon which the aiming device is mounted causes the image processor to decrease or increase respectively the field of view of the video image displayed by the image display component.

13. In an aiming device comprising, in a housing, an image sensor for acquiring video images of objects at which the device is aimed, a tilt sensor, an image processor for processing the images, an image display component for displaying in a field of view one or more of the video images captured by the image sensor, and a reference marker corresponding to an object of known size superimposed on the display component, a method of determining a range to a selected one of the objects at which the device is aimed, the method comprising:

aiming the device at the object;

viewing the object in a field of view displayed on the image display component; and causing, by the user tilting the aiming device beyond a predetermined threshold, the processor to change the field of view on the image display component until the object in the field of view matches the reference marker.

14. The method of claim 13 wherein causing includes changing the field of view by an increment corresponding to a predetermined distance value, and repeating the causing until the object in the field of view matches the reference marker or a predetermined maximum number of increments is reached.

15. The method of claim 14 wherein if the predetermined maximum number of increments is reached and the object in the field of view does not yet match the reference marker, then incrementally reducing the reference marker size for each subsequent change until the reference marker matches the object.

16. The method of claim 15 wherein the processor sums the changes to arrive at a final range to the object.

17. A method comprising:

providing an aiming device having a housing, the housing containing an image sensor for acquiring video images of objects at which the device is aimed, an image processor for processing the images, a tilt sensor, and an image display component for displaying in a field of view one or more of the video images captured by the image sensor;

aiming the device at an object of known size;

viewing the object in a field of view displayed on the image display component;

the processor placing a reference marker in the field of view, wherein the reference marker corresponds to the known size; and operating the tilt sensor to cause the processor to alter the field of view until the object in the field of view matches the size of the reference marker.

* * * * *